United States Patent [19]

Furuminato

[11] Patent Number: 4,981,001

[45] Date of Patent: Jan. 1, 1991

[54] JOINT STRUCTURE FOR MULTIPLE WINDOW

[75] Inventor: Kozo Furuminato, Kurobe, Japan

[73] Assignee: Yoshida Kogyo K. K., Tokyo, Japan

[21] Appl. No.: 450,526

[22] Filed: Dec. 14, 1989

[30] Foreign Application Priority Data

Dec. 16, 1988 [JP] Japan ..... 63-162425[U]

[51] Int. Cl.[5] ..... E04B 5/30; E04B 2/88

[52] U.S. Cl. ..... 52/235; 52/397

[58] Field of Search ..... 52/235, 398, 399, 397, 52/573

[56] References Cited

U.S. PATENT DOCUMENTS 4,543,755 10/1985 Crandell ..... 52/235

4,633,631 1/1987 Crandell ..... 52/399

FOREIGN PATENT DOCUMENTS 63-138390 9/1988 Japan .

*Primary Examiner*—John E. Murtagh

*Attorney, Agent, or Firm*—Hill, Van Santen, Steadman & Simpson

[57] ABSTRACT

A joint structure for joining two adjacent window frames includes a mullion body disposed between two opposed vertical frame members on the interior side of the window fames and connected to the vertical frame members by a pair of screws extending loosely through a pair of horizontal oblong holes, respectively, in the mullion body and threaded to the vertical frame members, and an elastic backup member disposed between the vertical frame members on the exterior side of the window frames. The vertical frame members and the mullion body disposed therebetween are relatively movable in a horizontal direction within an extent of movement of the screws along the horizontal oblong holes and within a limit of extent of elastic deformation of the elastic backup member. With this horizontal relative movement, thermal contraction and expansion of top and bottom horizontal frame members is accommodated or canceled out which would otherwise result in a bending of the vertical frame members.

10 Claims, 4 Drawing Sheets

JOINT STRUCTURE FOR MULTIPLE WINDOW

BACKGROUND OF THE INVENTION

1. Field of the Invention

The present invention relates generally to a multiple window having a plurality of horizontal window frames, and more particularly to a joint structure for such multiple window including a mullion disposed between vertical frame members of two adjacent window frames to join them together.

2. Description of the Related Art

Multiple windows of the type concerned are known, in which a vertical frame member of one of two adjacent window frames is joined by a mullion to a vertical frame member of the other window frame. One such known joint structure is disclosed in Japanese Utility Model Laid-open Publication No. 63-138390.

The disclosed joint structure includes a mullion composed of a body and a cover member. The body has a pair of first engagement recesses on its interior side and a pair of second engagement recesses at an intermediate portion thereof. The first and second engagement recesses are fitted with corresponding pairs of engagement fins projecting from outer side surfaces of the vertical frame members to preassemble the mullion body to the vertical frame members. Then the mullion body is secured by screws to the vertical frame members, and the cover member is attached by screws to the exterior side of the vertical frame members. The vertical frame members of the two adjacent window frames are thus joined together by means of the mullion.

With the known joint structure thus constructed, partly because the engagement recesses in the mullion body are fitted with the engagement fins of the vertical frame members, and partly because the cover member is screwed to the vertical frame members, the vertical frame members and the mullion are not relatively displaceable in a horizontal direction. With the horizontal relative movement thus prohibited, when an upper or a lower horizontal frame member of one window frame thermally expand or contracts, such thermal deformation cannot be accommodated or canceled out and rather brings about a bending or deformation of the vertical frame member of the same window frame.

SUMMARY OF THE INVENTION

With the foregoing difficulties in view, it is an object of the present invention to provide a multiple window having a joint structure which enables a horizontal relative displacement between vertical frame members of two adjacent window frames and a mullion disposed therebetween for preventing deformation of the vertical frame members due to thermal contraction and expansion of horizontal frame members of the window frames.

In brief, a joint structure for joining two adjacent window frames according to the present invention includes a mullion body disposed between two opposed vertical frame members on the interior side of the window frames and connected to the vertical frame members by a pair of screws extending loosely through a pair of horizontal oblong holes, respectively, in the mullion body and threaded to the frame vertical frame members, and an elastic backup member disposed between the vertical frame members on the exterior side of the window frames.

More particularly, according to the present invention, there is provided a multiple window including a joint structure interconnecting two adjacent vertical frame members of a plurality of window frames, the joint structure comprising: a pair of attachment fins projecting from outer side surfaces of the respective vertical frame members and disposed on interior portions of the respective outer side surfaces; a mullion including an elongate body disposed between the vertical frame members and an elongate cover attached to the body to conceal said body, the body including a first wall and a second wall joined with the first wall by a connecting wall and having a pair of horizontal oblong holes, the second wall lying over the attachment fins and connected to the attachment fins by a pair of screws extending loosely through the horizontal oblong holes, respectively, and threaded to the attachment fins, the first wall being disposed adjacent to exterior portions of the respective outer side surfaces; and an elastic backup member disposed between the first wall and the exterior portions of the outer side surfaces of the vertical frame members.

With the joint structure thus constructed, the vertical frame members and the mullion disposed therebetween are relatively movable in a horizontal direction within an extent of movement of the screws along the horizontal oblong holes and within a limit of extent of elastic deformation of the elastic backup member. The horizontal relative movement is effective to accommodate or cancel out thermal contraction and expansion of top and bottom horizontal frame members which would otherwise cause a bending of the vertical frame members.

The above and other objects, features and advantages of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 2:
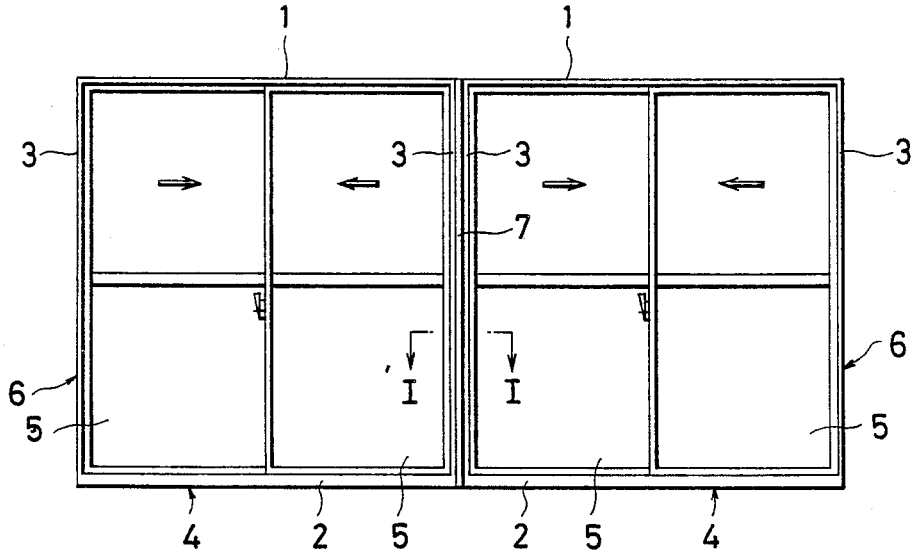
FIG. 2 is a front elevational view of a multiple window including two window frames connected together by the joint structure shown in FIG. 1.

Referring to the drawings, wherein like reference characters designate like or corresponding parts throughout the several views, and more particularly to FIG. 2, there is shown a multiple window comprising a plurality of horizontal sash windows (only two being shown) 6, 6 connected by a joint structure according to the present invention. The terms "interior", "exterior", "inner" and "outer" used herein to refer to respective directions as viewed from the center of each sash window 6 of the multiple window installed in a building.

Each of the sash window 6 includes double sliding sashes 5 slidably mounted in a rectangular window frame 4 mounted in an opening of a building (not shown). The window frame 4 includes top and bottom horizontal frame members 1, 2 connected at opposite ends with left and right vertical frame members 3, 3. The right vertical frame member 3 of the left window frame 4 and the left vertical frame member 3 of the right window frame 4 are connected together by a mullion 7 which constitutes a part of the joint structure of the present invention.

Figure 1:
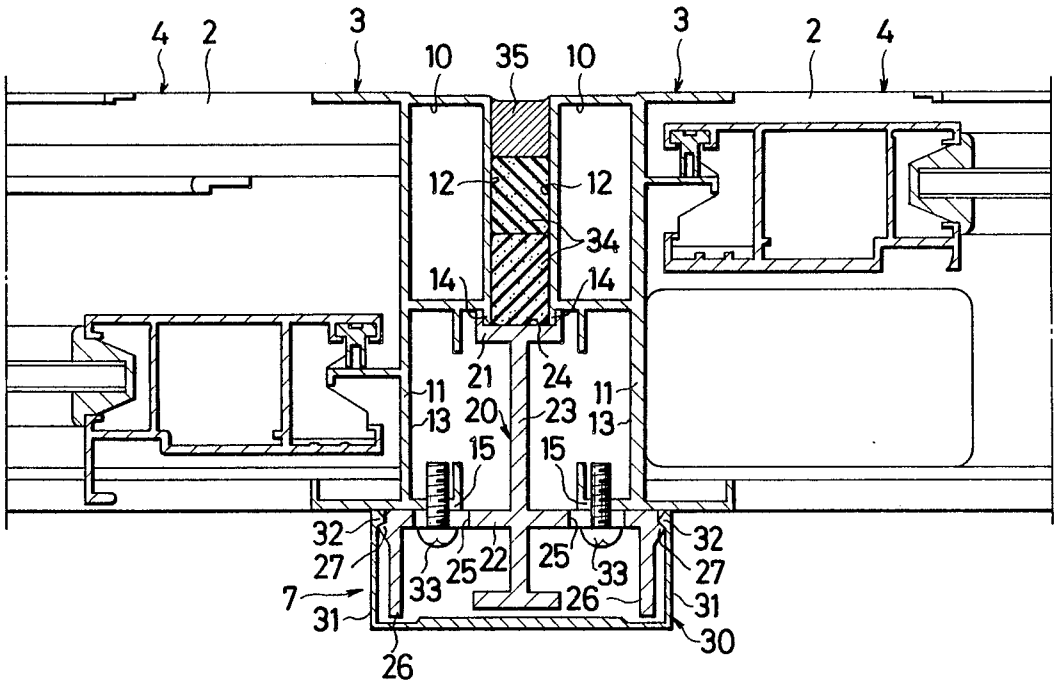
FIG. 1 is an enlarged cross-sectional view taken along I—I of FIG. 2, showing a joint structure for multiple windows according to the present invention.

As shown in FIG. 1, the right and left vertical frame members 3, 3 are disposed in confrontation to one another and each composed of a rectangular hollow exterior portion 10 and a planar interior portion 11 integral with and extending from an inner end of the hollow exterior portion 10. Thus, the vertical frame member 3 has a stepped outer side surface which includes an exterior portion 12 and an interior portion 13 extending parallel to each other, the exterior side surface portion 12 being disposed outwardly of the interior side surface portion 13. Each of the vertical frame members 3 further has an engagement fin 14 integral with the hollow exterior portion 10 and extending contiguously from the exterior side surface portion 12 toward the interior side of the vertical frame member 3 in parallel spaced relation to the interior side surface portion 13, and an inverted L-shaped attachment fin 15 integral with the planar interior portion 11 and projecting perpendicularly from the interior side surface portion 13. The attachment fin 15 extending along an interior edge of the vertical frame member 3.

The mullion 7 is composed of an elongate body 20 and an elongate cover 30 attached to the mullion body 20 to cover the mullion body 20, i.e. the inside construction of the joint structure. The mullion body 20 has a generally I-shaped transverse cross-section as shown in FIG. 2 and includes a first wall 21 on its exterior side and a second wall 22 on its interior side joined by a connecting wall 23 to the first wall 21. The first and second wall 21, 22 are parallel to each other and joined by the connecting wall 23 along there longitudinal central axes. The first wall 21 has in its exterior surface an engagement recess 24 extending along the length thereof. The second wall 22 has a pair of horizontal oblong holes 25, 25 disposed one on each side of the connecting wall 23, and a pair of guide fins 26, 26 projecting interiorly from opposite edge of second wall 22. The guide fins 26 have a pair of retainer ridges 27, 27, respectively, projecting from their bases or proximal ends in a direction away from each other The cover 30 has a generally U-shaped transverse cross section including a pair of confronting side strips 31, 31. The side strips 31 have on their distal ends a pair of confronting locking ridges 32, 32 lockingly engageable with the retainer ridges 27 of the mullion body 20 when the cover 30 is snapped on the second wall 22 of the mullion body 20. Though not shown, the body 20 of the mullion 7 is joined at its opposite ends to a skeleton frame of the building by means of brackets.

The engagement recess 24 of the first wall 21 is fitted over the engagement fins 14 of the two adjacent vertical frame members 3. The second wall 22 lies flatwise over interior surfaces of the attachment fins 15 and is connected to the respective attachment fins 15 by a pair of screws 33 extending loosely through the horizontal oblong holes 25 and threaded to the attachment fins 15. Two elongate backup members 34 formed of an elastic material such as sponge rubber are fitted between the confronting exterior side surface portions 12 of the vertical frame members 3. A caulking material such as a caulking compound 35 is filled in a space defined on the exterior side of the elastic backup members 34.

The joint structure of the foregoing construction enables the vertical frame members 3 and the mullion body 20 to move relatively to one another in a horizontal direction within a limit of elastic deformation of the elastic backup members 34 and a limited extent of movement of the screws 33 along the oblong holes 25. With this horizontal relative movement, a thermal contraction and expansion of the upper and lower horizontal frame members 1, 2 of the window frame 4 is canceled out or accommodated so that the vertical frame members 3 are always free from deformation.

In assembly, two adjacent window frames 4, 4 are horizontally disposed side by side with a space between their confronting vertical frame members 3. Then the mullion body 20 is inserted between the vertical frame members 3 from the interior side until the engagement recess 24 in respective vertical frame members 3 in which instance the second wall 22 overlies the interior surfaces of the respective attachment fins 15, with the horizontal oblong holes 25 held in registry with a pair of threaded holes (not designated) in the attachment fins 15. After the elastic backup members 34 are filled in a space defined between the confronting exterior side surface portions 12 of the vertical frame members 3 and the first wall 21 of the mullion body 20, the screws 33 are threaded into the threaded holes of the attachment fins 15 loosely through the horizontal oblong holes 25 to thereby join the mullion body 20 and the vertical frame members 3. Then the cover 30 is snap-fitted to the mullion body 20 to thereby conceal the joint structure Finally, the exterior side of the joint structure is sealed by the caulking material 35.

The foregoing assembling work is very simple partly because assembling of the mullion body 20 and the vertical frame members 3 can be achieved by merely inserting the mullion body 20 from the interior side into a space between the vertical frame members 3 which are held in horizontal juxtaposition, and partly because the fitting engagement between the engagement fins 14 and the engagement recess 24 prevents the vertical frame members 3 from spreading apart at the exterior side when the elastic backup members 34 are fitted between the exterior side surface portions 12 of the vertical frame members 3.

Figure 3:
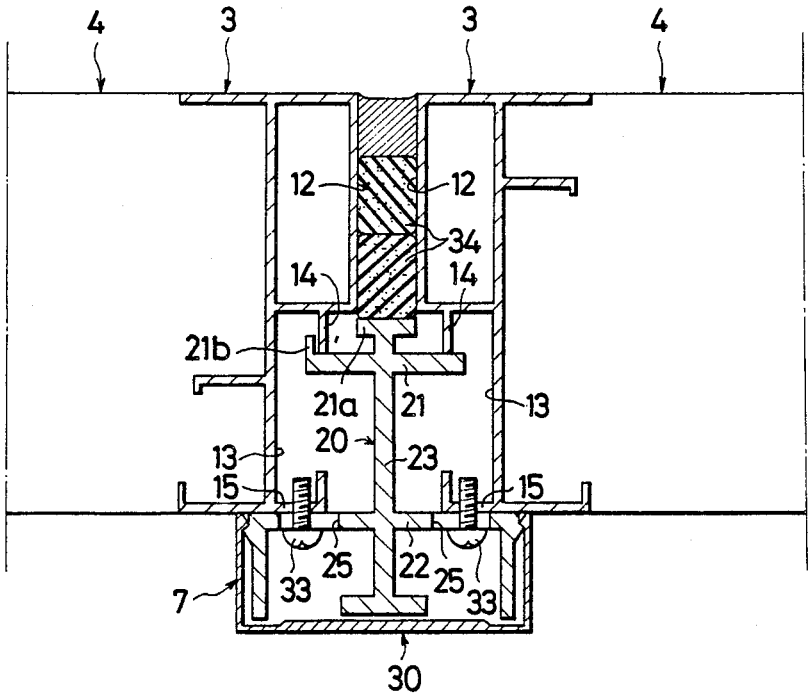
FIG. 3 is a view similar to FIG. 1, but showing a joint structure according to another embodiment.

FIG. 3 shows a modified joint structure according to the present invention The joint structure differs from the joint structure shown in FIG. 1 in that the first wall 21 of the mullion body 20 includes a T-shaped longitudinal retainer strip **21*a* projecting from the exterior surface of the first wall 21, and a longitudinal retainer fin 21*b* projecting exteriorly from one end edge of the first wall 21. The retainer strip 21*a* is located closely to the interior ends of the exterior side surface portions 12 so as to retain the elastic backup member 34 when it is inserted between the exterior side surface portions 12. The retainer fin 21*b* is engageable with the engagement fin 14 of one of the vertical frame members 3**.

The modified joint structure of the foregoing construction enables a different mode of assembly in which after the mullion body 20 is assembled with the vertical frame member 3 of one window frame 4 (left side one in the illustrated embodiment), the other window frame 4 is set on the mullion body by pushing the same from the lateral direction of the one window frame 3 and assembled with the mullion body 20.

Figure 4:
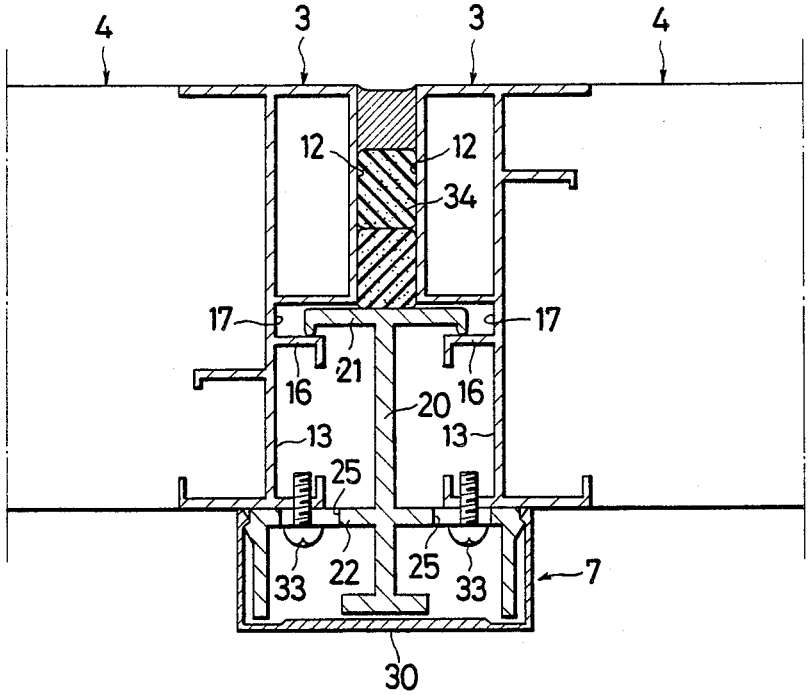
FIG. 4 is a view similar to FIG. 1, but showing a joint structure according to a further embodiment of the invention.

A modified joint structure shown in FIG. 4 is substantially the same as the joint structure shown in FIG. 1 excepting that the first wall 21 of the mullion body 20 is disposed closely to the interior ends of the exterior side surface portions 12 of the vertical frame members 3, and each vertical frame member 3 has an integral support strip 16 projecting perpendicularly from the interior side surface 13 and held in contact with the interior surface of the first wall 21. In other words, the opposite end edges of the first wall 21 are received in a pair of guide recesses 17, 17 each defined between one of the support strips 16 and a stepped portion of the corresponding outer side surface so that the vertical frame members 3 are substantially immovable relative to the mullion body 20 in a direction perpendicular to the plane of the sash window 6 even when the sash window 6 is subjected to a negative pressure tending to pull the sash window exterior side.

As described above, the vertical frame members 3 and the mullion 7 are relatively movable in a horizontal direction within a limit of extent of elastic deformation of the elastic backup members 34 and within a limited extent of movement of the screws 33 along the horizontal oblong holes 25. Such horizontal relative movement accommodates or cancels out the thermal contraction and expansion of the upper and lower horizontal frame members 1, 2 which would otherwise results in a bending or deformation of the vertical frame members 3. According to the embodiment shown in FIG. 1, the retainer recess 24 provided in the first wall 21 of the mullion body 20 is fitted over the engagement fins 14 on the vertical frame members 3. With this fitting engagement, the spacing between the opposed vertical frame members 3 is kept in the designed distance and hence insertion of the elastic backup members 34 between the vertical frame members 3 can be achieved smoothly and easily. A further advantage attainable by this fitting engagement is that assembling of the mullion 7 and two adjacent window frame 4 can be achieved with utmost ease by simply inserting the mullion body 20 between the vertical frame members 3 after the window frames 4 are horizontally juxtaposed in a vertical plane.

Obviously, various minor changes and modifications of the present invention are possible in the light of the above teaching. It is therefore to be understood that within the scope of the appended claims the invention may be practiced otherwise than as specifically described.

What is claimed is:

1. A multiple window including a joint structure interconnecting two adjacent vertical frame members of a plurality of window frames, said joint structure comprising (a) a pair of attachment fins projecting from outer side surfaces of the respective vertical frame members and disposed on interior portions of the respective outer side surfaces;

(b) a mullion including an elongate body disposed between the vertical frame members and an elongate cover attached to said body to conceal said body, said body including a first wall and a second wall joined with said first wall by a connecting wall and having a pair of horizontal oblong holes, said second wall lying over the attachment fins and connected to the attachment fins by a pair of screws extending loosely through said horizontal oblong holes, respectively, and threaded to said attachment fins, said first wall being disposed adjacent to exterior portions of the respective outer side surfaces; and (c) an elastic backup member disposed between said first wall of said body and the exterior portions of the outer side surfaces of the vertical frame members.

2. A multiple window according to claim 1, further including a pair of engagement fins projecting from said exterior portions of the respective outer side surfaces toward the interior side of said mullion body, said first wall of said mullion body having an engagement recess fitted over said engagement fins.

3. A multiple window according to claim 1, wherein said cover is snapped on said second wall of said mullion body.

4. A multiple window according to claim 3, wherein said second wall has a pair of retainer ridges, said cover has a pair of locking ridges lockingly engageable with said retainer ridges.

5. A multiple window according to claim 4, wherein said second wall has a pair of guide fins projecting interiorly of said second wall, said retainer ridges being disposed on proximal ends of the respective guide fins, and said cover has a U-shaped cross-sectional shape and includes a pair of confronting side strips, said locking ridges projecting from distal ends of the respective side strips.

6. A multiple window according to claim 1, wherein said outer side surfaces of the respective vertical frame members confront each other and are stepped, said exterior portions of the stepped outer side surfaces extending parallel to said interior portions of the outer side surfaces and being disposed outwardly of said interior portions, said first wall of said mullion body having an exterior surface held in contact with interior ends of the respective outer portions of the stepped outer side surface.

7. A multiple window according to claim 6, wherein said vertical frame members have a pair of engagement fins projecting contiguously from said interior ends of the respective exterior portions toward the interior side of said mullion body, said first wall having an engagement recess fitted over said engagement fins.

8. A multiple window according to claim 1, wherein said outer side surfaces of the respective vertical frame members confront each other and are stepped, said exterior portions of the stepped outer side surfaces extending parallel to said interior portions of the outer side surfaces and being disposed outwardly of said interior portions, said first wall of said mullion body having a retainer fin disposed along a longitudinal edge of said first wall and projecting perpendicularly from the exterior surface thereof, said vertical frame members having a pair of engagement fins extending toward the interior side of said mullion body, said retainer fin being engageable with one of said engagement fins.

9. A multiple window according to claim 8, wherein said first wall further has a generally T-shaped retainer strip projecting from the exterior surface thereof and held in contact with said elastic backup member.

10. A multiple window according to claim 1, wherein side surfaces of the respective vertical frame members confront each other and are stepped, said exterior portions of the stepped outer side surfaces extending parallel to said interior portions of the outer side surfaces and being disposed outwardly of said interior portions, said vertical frame members having a pair of support strips projecting from the respective stepped outer side surface and defining jointly with said stepped outer side surface a pair of guide recesses, said first wall being disposed adjacent to interior ends of the respective exterior portions of the stepped side surfaces and having opposite edges received in said guide recesses.

* * * * *